United States Patent [19]

Finkbeiner et al.

[11] 3,965,918

[45] June 29, 1976

[54] ELECTRO-FLUIDIC SIGNAL CONVERTER

[75] Inventors: Ludwig Finkbeiner, Walheim; Rudolf Jurinke, Ludwigsburg; Volkmar Leutner, Hemmingen; Roman Romes, Friolzheim, all of Germany

[73] Assignee: Robert Bosch G.m.b.H., Stuttgart, Germany

[22] Filed: June 28, 1974

[21] Appl. No.: 484,335

[30] Foreign Application Priority Data

July 3, 1973 Germany ..... 2333690

[52] U.S. Cl. ..... 137/83; 137/831

[51] Int. Cl.[2] ..... F15C 3/12

[58] Field of Search ..... 137/83, 831, 833; 91/3; 335/219

[56] References Cited

UNITED STATES PATENTS

| | | | |
|---|---|---|---|
| 3,442,280 | 5/1969 | Boothe | 137/833 |
| 3,774,644 | 11/1973 | Leutner et al. | 137/831 |

*Primary Examiner*—William R. Cline
*Attorney, Agent, or Firm*—Michael J. Striker

[57] ABSTRACT

An electro-fluidic signal converter has a body provided with an inlet and two outlets for pressure fluid. The body is composed of a pair of outer non-magnetic plates and a plurality of laminated-together inner magnetizable plates which are fluid-tightly sandwiched between the outer plates. The inner plates have respective plate portions which together constitute a body section that is resiliently deflectable out of a neutral position, and this body section is formed with a fluid channel which communicates with the inlet and has a discharge orifice that communicates equally with both of the outlets when the body section is in its neutral position. An electromagnet is located adjacent the body and is energizable to thereby deflect the body section out of its neutral position to one of a plurality of operated positions in which the discharge orifice communicates preferentially with one of the outlets. A method of making the body is also disclosed.

11 Claims, 6 Drawing Figures

ELECTRO-FLUIDIC SIGNAL CONVERTER

BACKGROUND OF THE INVENTION

The present invention relates generally to a signal converter, and more particularly to an electro-fluidic signal converter. Still more specifically, the invention relates to an electro-fluidic signal converter having a body which is composed of laminated-together plates, and to a method of making such a converter.

Electro-fluidic signal converters are devices through which a stream of fluid flows, and wherein the fluid stream is channeled in corresponding with an incoming electrical signal, to produce at the output of the converter a fluid signal in form of a differential pressure whose magnitude is proportional to that of the incoming electrical signal. Converters of this type are already well known in the art e.g. from U.S. Pat. No. 3,774,644.

Fluidic-signal converters operate either with a stream of compressed gas or with a stream of liquid, for example a hydraulic fluid. If they are of the type that operates with a stream of liquid then it is necessary to collect leakage fluid and/or such fluid which does not enter the output of the converter, and to guide it away, advantageously back into a fluid reservoir. Heretofore, this has not been reliably possible, because such converters were never quite sealed with respect to their surroundings.

SUMMARY OF THE INVENTION

Accordingly, it is an object of the present invention to provide an electro-fluidic signal converter of the type under discussion, which avoids the aforementioned disadvantage.

More particularly, it is an object of the invention to provide such an electro-fluidic signal converter which is completely sealed with respect to its surroundings.

An additional object of the invention is to provide such a signal converter which has a body that is composed of a plurality of laminated-together plates.

A further object of the invention is to provide a method of making such a body.

In pursuance of these objects, and of others which will become apparent hereafter, one feature of the invention resides in an electro-fluidic signal converter which, briefly stated, comprises a body having an inlet and two outlets for pressure fluid, said body being composed of a pair of outer non-magnetic plates and a plurality of laminated-together inner magnetizable plates which are fluid-tightly sandwiched between the outer plates. The inner plates have respective plate portions which together constitute a body section that is resiliently deflectable out of a neutral position. The body section is formed with a fluid channel which communicates with the inlet and which has a discharge orifice that communicates equally with both of the outlets when the body section is in its neutral position. Electromagnetic means is provided adjacent the body and is energizable to thereby deflect the body section out of its neutral position to one of a plurality of operated positions in which the discharge orifice communicates preferentially with one of the outlets.

The inner plates are advantageously of ferro-magnetic material, preferably an iron-nickel alloy, and the outer plates are advantageously of a titanium alloy.

The present invention overcomes the difficulties of the prior art, in that it completely seals the body with respect to its surroundings. Furthermore, it assures that the magnetic flux which is necessary to effect the resilient deflection of the body section out of its neutral position, is not shorted by the outer plates since the latter are of non-magnetic material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
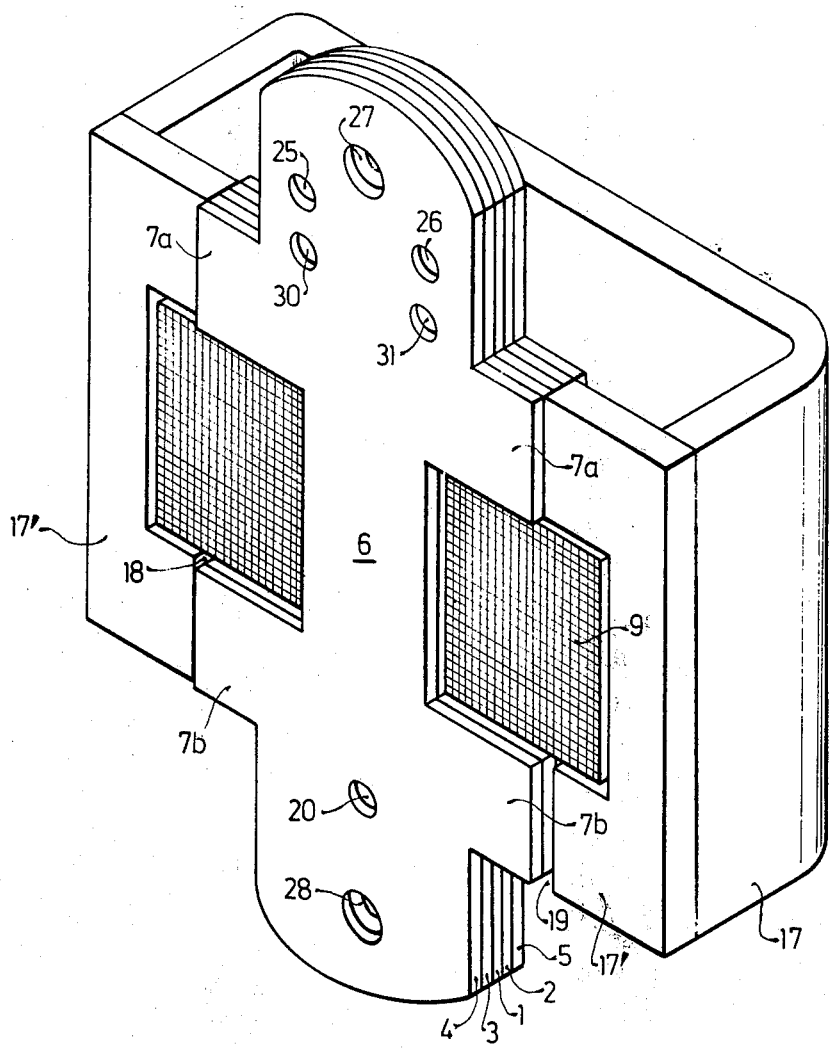
FIG. 1 is a perspective view, illustrating an electro-fluidic signal converter according to the present invention.

The electro-fluidic signal converter according to the present invention is shown in FIG. 1 in a somewhat diagrammatic perspective view. It is essentially composed of a body which in this embodiment is made up of the five plates shown in detail in FIGS. 2*a*–2*e*, respectively, an electromagnetic coil 9 that is wound around the center portion 6 of this body, a pair of soft-iron yokes 17', and a permanent magnet 17 of generally U-shaped configuration.

The body of the converter is composed of the five plates 1, 2, 3, 4 and 5. It should be understood that more than five plates could be provided, and that this number has been chosen only by way of illustration and example. FIG. 1 shows that the sequence in which the plates are numbered, from left to right of the Figure, is plate 4, plate 3, plate 1, plate 2 and plate 5. Plates 4 and 5 are therefore the non-magnetic outer plates, and plates 3, 1 and 2 are inner plates of which plate 1 is sandwiched between the plates 2 and 3.

The outer plates 4, 5 in this embodiment are of a titanium alloy, although another non-magnetic material might also be used. The plates 3, 1 and 2 are of a magnetizable material, advantageously a ferro-magnetic material, of which an iron-nickel alloy has been found to be particularly valuable. All of the plates 1–5 have the same overall contour, namely an essentially rectangular shape having rounded ends and being provided at longitudinally spaced locations with respective transversely extending cross bars 7*a* and 7*b*. Since in FIG. 1 the converter has been shown in an upright position, so that the cross bars 7*a* are located at the top and the cross bars 7*b* at the bottom, reference will hereafter be made to top and bottom and is always intended to refer to the orientation of the respective plates which they have in FIG. 1.

The plates 1–5 all have a center portion 6 which is relatively narrow and which in the magnetizable plates 1, 2 and 3 is composed of only two very narrow strips 8 in order to obtain rapid magnetic saturation; actually, the width of the strips 8 is determined only by the requirement that they must have a certain structural strength; as long as this requirement can be met, the strips 8 can be made as narrow as is consistent with such requirement.

Referring now in detail to FIGS. 2*a*–2*e*, which show the respective plates 4, 3, 1, 2 and 5, that is which illustrate them in the same order in which they are shown from left to right in FIG. 1, it will be seen that located inwardly of the strips 8 of the plates 1, 2 and 3 there is a plate portion 10 which is outlined and defined by a pair of incisions 11 that extend essentially parallel to the axis of symmetry of the respective plate and which originate in a cutout 12 located at the upper end of the respective plate 1, 2, 3. Together with the strips 8, the plate portion 10 constitutes the armature of the electromagnet shown in FIG. 1. It is evident that the plate portions 10 which are elongated, are held only at one end to the remainder of the respective plates, when the elongation of the incisions 11 is traced and it is found that they merge into incisions 13 extending normal to the elongation of the incisions 11, and which in turn merge into inwardly offset longitudinally extending incisions 14. The provision of the incisions 13 and 14 assures that the effective cross-section of the plate portion 10, where the latter is connected with the remainder of the respective plate 1, 2 and 3, is so weakened that the plate portion 10 can readily be deflected out of its neutral position in the plane of its respective plate 1, 2 or 3, when the electromagnet is energized.

Only the portions 6 of the plates surrounded by the winding 9, from which it will be seen that the upper end portion of the respective plate portions 10 extend out of the winding 9. This upper end portion, located at the level of the cross bar 7, is formed with claw-like projections 15 which extend into similarly configurated cutouts 16 but are sufficiently spaced from the same to define a labyrinth time extension of the straight parts of the incisions 11.

Figure 2A:
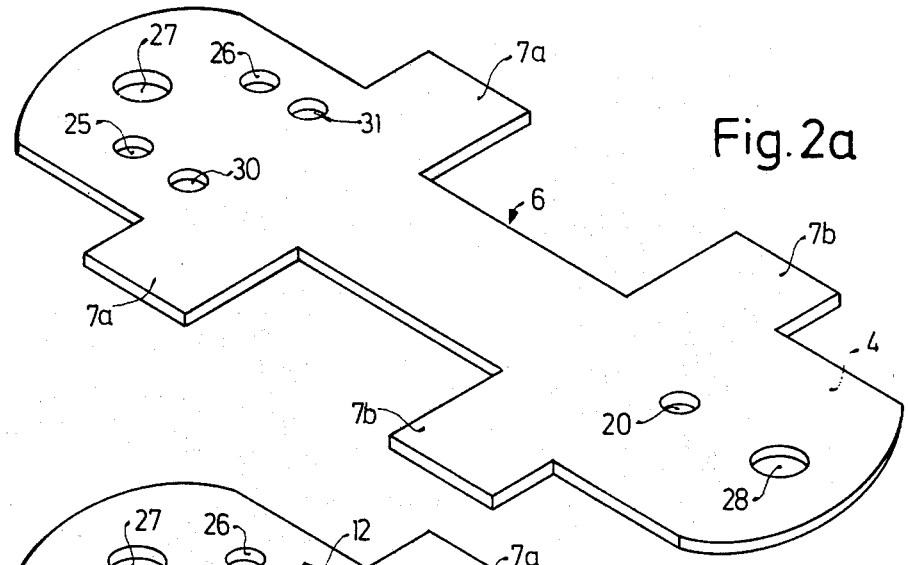
FIGS. 2*a*–2*e* each show one of the plates of which the body of the signal converter in FIG. 1 is composed.
Figure 2B:
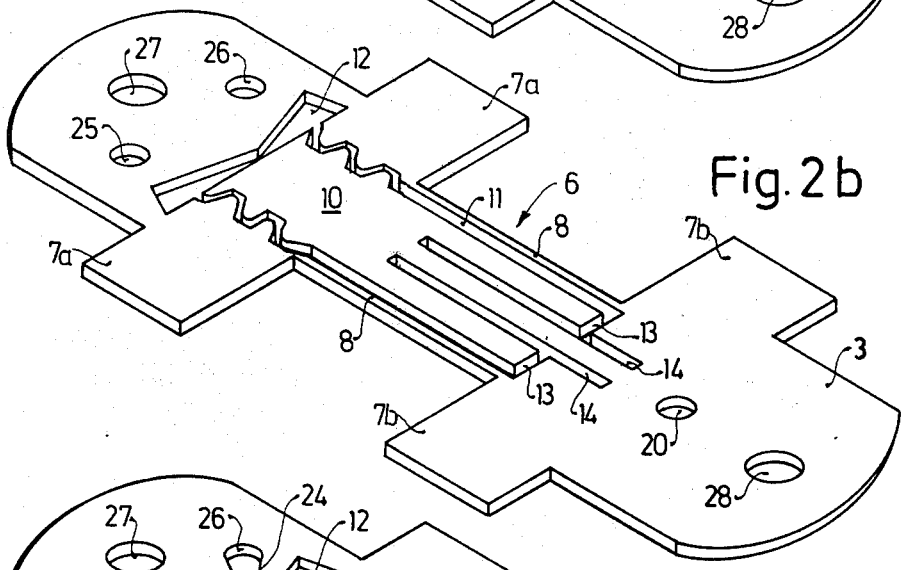
Figure 2C:
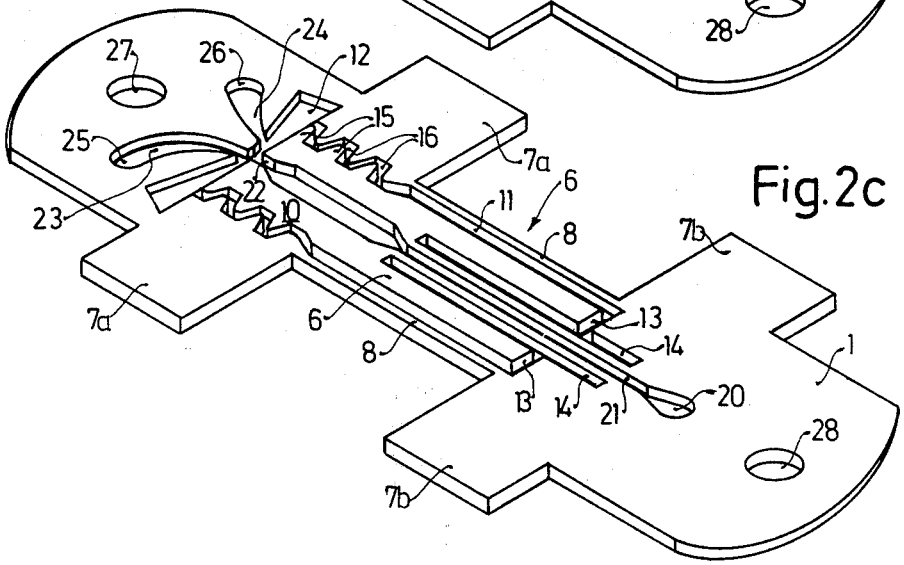
Figure 2D:
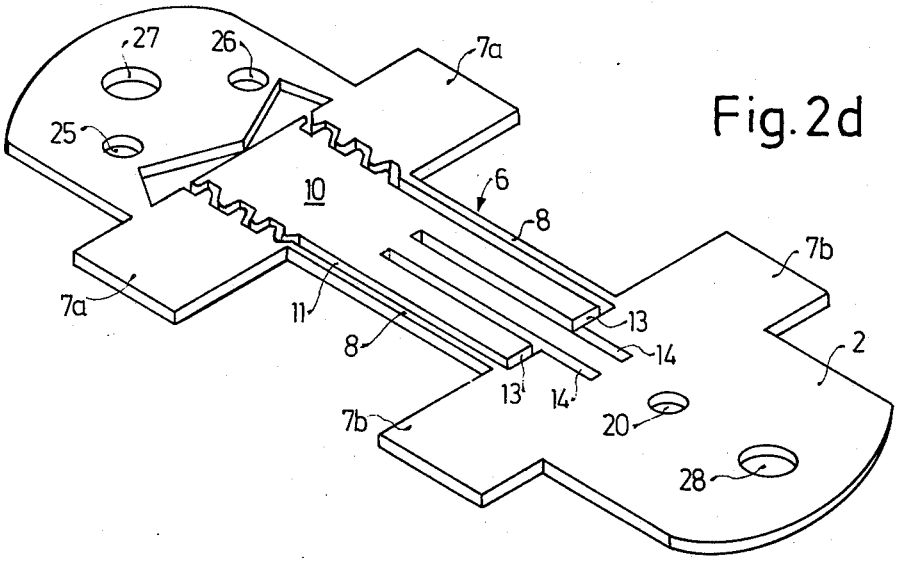
Figure 2E:
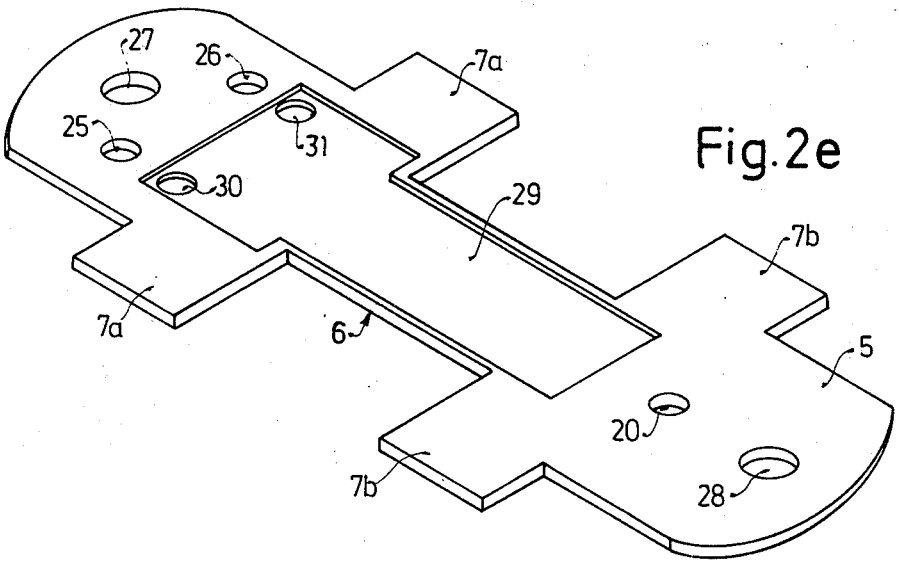

The center plate 1 is formed with a slot-shaped channel 21 extending longitudinally of it and communicating with an inlet bore 20; at its end remote from the inlet bore 20 the channel 21 has a nozzle or orifice 22 which communicates with the cutout 12; the latter in turn communicates via the channels 23, 24 with outlet bores 25, 26. When the plate 1 of FIG. 2*c* is sandwiched between the plates 3 of FIG. 2*b* and 2 of FIG. 2*d*, the three plates together define a flow channel which is constituted by the channel 21 that is closed at the opposite major surfaces of the plate 1 by the presence of the plates 3, 2. This channel 21 extends along the axis of symmetry of the respective plates 1–3, and thus of the body that is surrounded by the winding 9. It should be noted that the inlet bore 20 and the outlet bores 25, 26 are present in all of the plates 1–5, as are mounting holes 27, 28 by means of which the body composed of the plates 1–5 can be mounted. The cutouts 12 are of course present only in plates 1–3, since the plates 4 and 5 must be closed to be able to constitute cover plates that prevent the escape of fluid. The outlet channels 23, 24 are constructed as diffusers, as is evident from a consideration of plate 1 in FIG. 2*c*.

While the plates 1–3 are of a magnetic material, preferably an iron-nickel alloy, the plates 4 and 5 are of a non-magnetic material, preferably a titanium alloy. The plates 4 and 5 are formed in their sides which face the plates 3 and 2, respectively, with recesses 29 of substantially T-shaped outline. This has been illustrated only for the plate 5 in FIG. 2*e*, but should be understood to be similarly true of the plate 4 on that side thereof which is not visible in FIG. 2*a*. Located at the upper end of the recesses 29 are a pair of bores 30, 31 extending through the respective plates 4, 5 and located approximately at the level of the cutouts 12 of the plates 1–3. The outline of the recesses 29 is so selected that when the plates 1–3 are sandwiched between the plates 4 and 5 the plates portions 10 will be able to move freely in the space which exists due to the presence of these recesses 29. The purpose of the bores 30, 31 is to connect this space, which of course includes the space defined by the cutouts 12 in the plates 1–3, either with the atmosphere or with conduits that return excess fluid back to a reservoir.

The individual plates 1–5 are soldered together or brazed together over their entire respective interfaces in fluid-tight and pressure-tight relationship. This connection is established in two different stages. First, the plates 2 and 3 are placed against the plate 1, so that the same is sandwiched between them, and are soldered to the plate 1 over their entire interfaces with the plate 1. This is done by using a copper containing filler material if the plates 1–3 are of ferro-magnetic material, especially of an iron-nickel alloy. It is particularly advantageous to use pure copper as the filler material and to connect the plates 1–3 by brazing.

Once this is done, the second stage is carried out, in which the plates 4 and 5 are placed against the sub-assembly composed of the plates 1–3, and are soldered to this sub-assembly over their entire interfaces with the respective plates 2 and 3.

If, as is currently preferred, the plates 4 and 5 are of a titanium alloy, it is necessary to first apply a nickel coating to them in order to provide them with an active solderable surface. Thereafter the plates 4 and 5 are soldered to the plates 2 and 3 with solder whose melting point is lower than that of the filler material, such as a solder or brazing compound used for connecting the plates 1–3 with one another. A solder suitable for connecting the plates 4, 5 to the plates 2, 3 would be a silver solder.

This two-stage sequence of connection has the advantage that it is first possible to cleanly and reliably connect the ferro-magnetic plates 1–3 with one another, and that thereafter the plates 4 and 5 can be connected to the thus-established sub-assembly by soldering at a temperature which is below that at which the brazing compound or soldering compound used for connecting the plates 1–3 would melt, so that a dissolution of the connection established in the first stage is avoided during the soldering carried out during the second stage. The deposition of solder and also of the nickel coating on the plates 4, 5 can be carried out according to any conventional process, for instance in a galvanic bath.

When the body composed of the plates 1–5 is thus completed, the winding 9 is placed around its center portion 6. The upper and lower cross bars 7*a* and 7*b* are then connected magnetically at the opposite sides of the plane of symmetry of the body by respective soft-iron yokes 17′, as shown in FIG. 1. It should be noted that the cross bars 7*a* are in contact with the adjacent poles of the yokes 17′, whereas air gaps 18, 19 exist between the lower cross bars 7*b* and the respective adjacent poles of these yokes. Each of the yokes 17*b* cooperates with a pole of a permanent magnet 17 which, as mentioned earlier is of substantially U-shaped outline. Each arm of the permanent magnet 17 is in contact with a respective yoke 17′ over the entire length and width of the respective arm.

The operation of the electro-fluidic signal converter described herein is already known from the art. An incoming electrical signal energizes the electromagnet and is converted into an analog fluidic signal, due to the fact that the plate portions 10 — which are united for movement in unison by the connection of the plates 1–3 — are deflected laterally in correspondence with the electric current flowing through the winding 9. The stream of fluid issuing from the orifice 22 and previously equally directed into the outlet channels 22 and 24, is thus preferentially directed to one of the outlet channels 23 or 24, that is one of these channels 23 or 24 will receive more fluid and be under greater pressure than the other one for the duration of the electrical signal, so that a differential pressure output signal develops either at the outlet 26 or the outlet 25 which is proportional to the electrical signal.

The operation of the electromagnet is, of course, entirely conventional and known from the art, including the art of electro-fluidic signal converters, so that it need not be further discussed.

It will be appreciated that a larger number of plates can be used, for instance if larger flow-through cross-sections are required for the fluid stream. Similarly, other modifications may be made from the embodiment that has been illustrated and described herein, without thereby departing in any way from the concept and intent of the invention. Thus, where the recesses 29 in the illustration embodiment may have been produced by chemical removal of material, that is by etching or the like, they could be formed by milling, punching or the like.

It will be understood that each of the elements described above, or two or more together, may also find a useful application in other types of constructions, differing from the types described above.

While the invention has been illustrated and described as embodied in an electro-fluidic signal converter, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An electro-fluidic signal converter, comprising a body having an inlet and two outlets for pressure fluid, said body being composed of a pair of outer non-magnetic plates and a plurality of laminated-together inner magnetizable plates which are fluid-tightly sandwiched between said outer plates, said inner plates having respective plate portions which together constitute a body section that is resiliently deflectable out of a neutral position, and said body section being formed with a fluid channel which communicates with said inlet and which has a discharge orifice that communicates equally with both of said outlets when said body section is in said neutral position; and electromagnetic means adjacent said body and energizable for deflecting said body section out of said neutral position to one of a plurality of operated positions in which said discharge orifice communicates preferentially with one of said outlets, the non-magnetic character of said outer plates preventing shorting of the magnetic flux path required for effecting the deflecting of said body section.

2. An electro-fluidic signal converter as defined in claim 1, wherein said inner plates of ferro-magnetic material.

3. An electro-fluidic signal converter as defined in claim 2, wherein said material is an iron-nickel alloy.

4. An electro-fluidic converter as defined in claim 3, wherein said inner plates are fluid-tightly brazed with copper-containing brazing substance over their entire respective interfaces.

5. An electro-fluidic signal converter as defined in claim 4, wherein said outer plates are of titanium alloy and coated with a nickel layer.

6. An electro-fluidic signal converter as defined in claim 5, wherein said outer plates are soldered to the respectively adjacent inner plates over their entire respective interfaces, with a solder having a melting point lower than said brazing compound.

7. An electro-fluidic signal converter as defined in claim 6, wherein said solder is a silver solder.

8. An electro-fluidic signal converter as defined in claim 3, wherein said inner plates are fluid-tightly brazed to one another with pure copper over their entire respective interfaces.

9. An electro-fluidic signal converter as defined in claim 1, wherein said outer plates are of titanium alloy.

10. An electro-fluidic signal converter as defined in claim 1, wherein said outer plates define with said inner plates an inner space for leakage fluid; and further comprising a venting port communicating with said inner space for venting leakage fluid from the latter.

11. An electro-fluidic signal converter as defined in claim 1, wherein each of said plates is fluid-tightly bonded to a respectively adjacent plate at its interface with the same.

* * * * *